US005735416A

United States Patent [19]

Jussila

[11] Patent Number: 5,735,416

[45] Date of Patent: Apr. 7, 1998

[54] TRAVERSING GEAR ARRANGEMENT FOR A CRANE MOVING ON RUBBER TIRED WHEELS OR THE LIKE

[75] Inventor: Olavi Jussila, Hyvinkää, Finland

[73] Assignee: KCI Konecranes International Corporation, Hyvinkaa, Finland

[21] Appl. No.: 612,963

[22] PCT Filed: Jul. 7, 1995

[86] PCT No.: PCT/FI95/00935

§ 371 Date: May 28, 1996

§ 102(e) Date: May 28, 1996

[87] PCT Pub. No.: WO96/02455

PCT Pub. Date: Feb. 1, 1996

[30] Foreign Application Priority Data

Jul. 15, 1994 [FI] Finland ..... 943399

[51] Int. Cl.[6] ..... B66C 5/02

[52] U.S. Cl. ..... 212/344; 180/23; 180/264; 310/67 R; 414/460

[58] Field of Search ..... 212/344; 180/23, 180/24.03, 24.06, 24.07, 65.5, 264; 414/460; 310/67 R

[56] References Cited

U.S. PATENT DOCUMENTS

| | | | |
|---|---|---|---|
| 1,577,304 | 3/1926 | Schurch | 310/67 R |
| 3,055,448 | 9/1962 | Fagel | 180/65.5 |
| 3,280,931 | 10/1966 | Cahill et al. | 180/23 |
| 3,616,761 | 11/1971 | Valls | 310/67 R |
| 3,645,406 | 2/1972 | Brazell | 180/264 |
| 3,897,843 | 8/1975 | Hapeman et al. | 180/65.4 |
| 4,763,800 | 8/1988 | Engler et al. | 212/344 |

FOREIGN PATENT DOCUMENTS

| | | | |
|---|---|---|---|
| 1426857 | 9/1988 | U.S.S.R. | 180/65.5 |

*Primary Examiner*—Thomas J. Brahan

[57] ABSTRACT

The invention relates to a traversing gear arrangement for a crane moving on rubber-tired wheels or the like. The crane having an electric motor functioning as the traversing gear and including gearing and wheels arranged in pairs. The wheels in each of the pairs of wheels are connected to each other by a hollow pipe shaft such that one of the wheels is a drive wheel, while the other is a free wheel. The traversing gear connected to the drive wheel is mounted inside the pipe shaft.

4 Claims, 2 Drawing Sheets

TRAVERSING GEAR ARRANGEMENT FOR A CRANE MOVING ON RUBBER TIRED WHEELS OR THE LIKE

The invention relates to a traversing gear arrangement for a crane moving on rubber-tired wheels or the like.

BACKGROUND OF THE INVENTION

In prior art, a sub-chassis of a crane moving on rubber-tired wheels comprises two large wheels one after the other, and the wheels can be turned to be parallel for lateral movement. The turning is conducted by turning the wheels to the same direction with a hydraulic cylinder or aggregate in a place specifically reserved for turning, e.g. on a marble slab. Another possibility is to lift the wheels from the ground for the duration of the turning action. Instead of two large wheels, the sub-chassis may comprise a pair of small wheels, both of which are drive wheels. In the traversing movement, power transmission is usually implemented by open gearing with chain gears and transmission chains.

U.S. Pat. Nos. 3,280,931 and 3,645,406 teach a solution in which a sub-chassis of a crane comprises two parallel wheels that are both drive wheels. The pair of wheels is turned with a separate turning gear. The disadvantage of the prior art arrangement is that turning is difficult. Further, because of the hydraulic equipment and chain gearing, many components are needed, and so there are many points that may need servicing or that may leak. Chain gearing, implemented as open gearing, extends at least partly beyond the wheelwork and thereby requires a lot of space and, since it is not sufficiently protected against minor bumps, may be easily damaged.

SUMMARY OF THE INVENTION

The object of the present invention is to overcome the above disadvantages and to provide a new and advantageous solution for a traversing gear arrangement of a crane moving on rubber-tired wheels or the like. Embodiments of the invention are characterized by what is set forth in the other claims.

An advantage of the invention is that the traversing gear will be protected inside a pair of wheels. The gear casing is small and compact: no parts extend beyond the tires. Because there are few components, little servicing is needed. Another advantage is that the wheels can be turned without any additional apparatus, such as hydraulic equipment, and the turning can be performed anywhere. Yet another advantage is that the wheels can be turned steplessly, so it is possible to move the crane diagonally or in a circle. Also, the turning does not wear the tires notably.

BRIEF DESCRIPTION OF THE DRAWINGS

In the following the invention will be described in greater detail by means of one embodiment with reference to the attached drawings, in which.

DETAILED DESCRIPTION OF THE INVENTION

Figure 1:
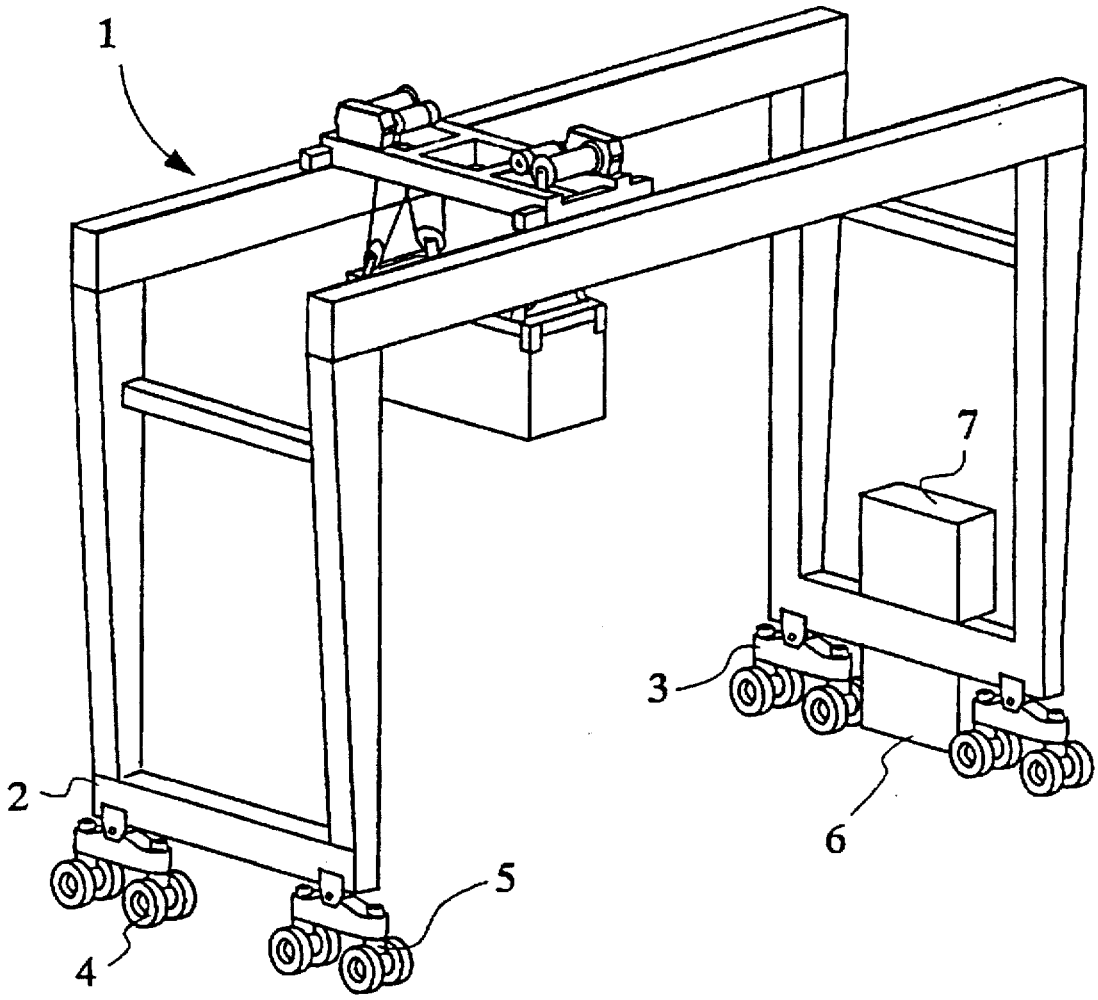
FIG. 1 shows a diagonal top view of a crane.

FIG. 1 shows a crane 1 in which the invention is used, four sub-chassis assemblies 3 being fitted on two lower beams 2 of the frame structure at the lower corners of the crane. Each sub-chassis comprises two pairs of wheels 4 mounted in the middle of the horizontal shaft between the pair of wheels on vertical pipes 5 located at the ends of the sub-chassis such that they pivot about the vertical axis of the vertical pipe 5. The crane is also provided with a diesel generator 6, which supplies the crane with power, and a electric distribution unit 7. The traversing gear of the crane, which is not shown in FIG. 1, is arranged in connection with the pairs of wheels 4 and comprises e.g. a secondary shaft 19, gearing 16, an electric motor 28, and a brake 29 affecting the shaft of the electric motor.

Figure 2:
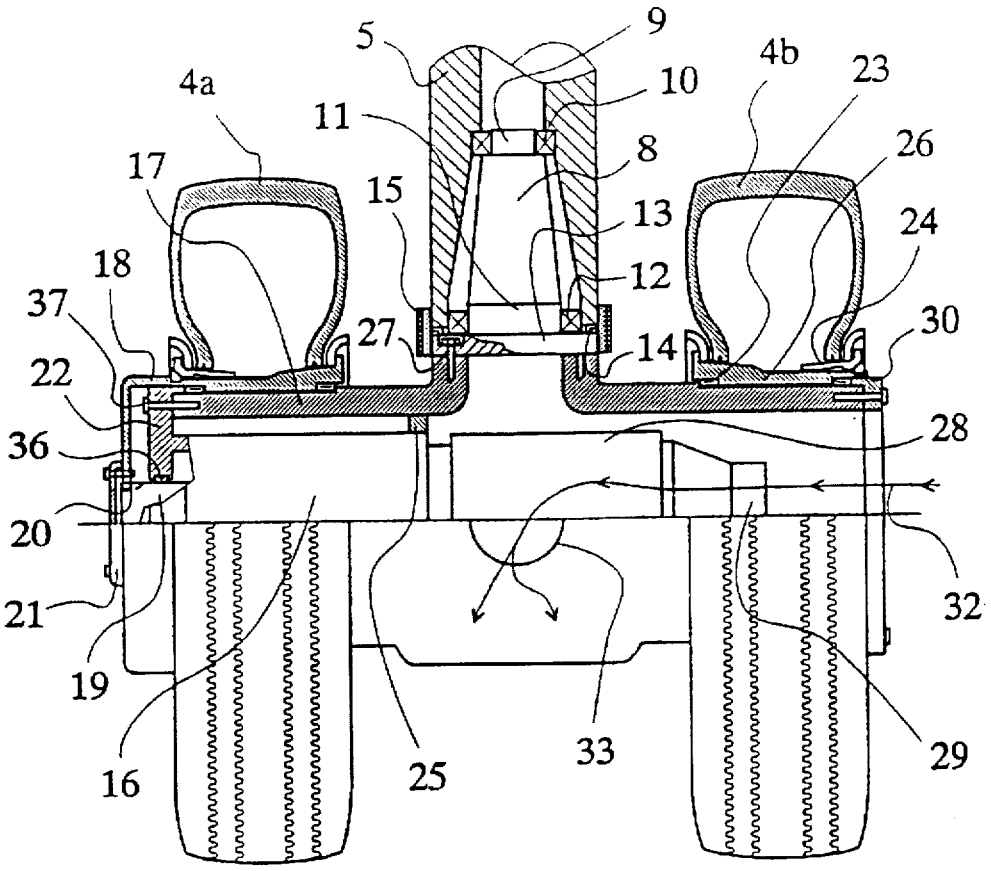
FIG. 2 shows a shaft arrangement in one pair of wheels on a sub-chassis in the longitudinal direction of the sub-chassis.
Figure 3:
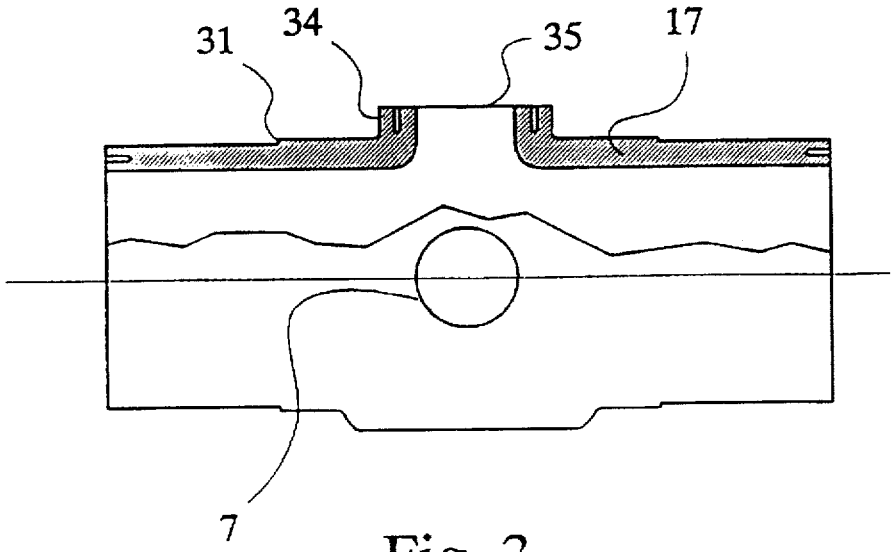
FIG. 3 shows a partly cross-sectional side view of a pipe shaft in one pair of wheels.

FIG. 2 shows the structure in greater detail. At both ends of the sub-chassis, a vertical pipe 5 extends downward from the sub-chassis; the pipe is hollow, and expands conically on the inside toward the bottom. At the upper end of the conical expansion there is a space for a bearing 10, and at the lower end of the expansion there is a space for a lower bearing 12. Each pair of wheels 4 is mounted on a conical hole in the vertical pipe to pivot about the vertical axis of the hole by means of a king pin 8, which comprises an upper cylindrical bearing area 9 for bearing 10 and a lower cylindrical bearing area 11 for bearing 12. The part of the king pin between the bearing areas narrows conically toward the top, and so the diameter of bearing area 9 is smaller than that of bearing area 11. Immediately below bearing area 11, the king pin further comprises a cylindrical flange 13, whose diameter is greater than that of bearing area 11. The flange provides a supporting surface for bearing 12, and the king pin is fastened at this flange to a pipe shaft 17 between wheels **4*a* and 4*b* of the pairs of wheels 4 with fastening bolts 27**.

At the lower end of the vertical pipe 5 there is also a locking device, such as a band brake 15, affecting the lower end of the vertical pipe and the flange 13 of the king pin 8, the locking device being springdrivenly pressed against the lower end of the vertical pipe and the perimeter of the flange as the brake is in the hold position. The brake is released by means of a spindle motor (not shown in the figs.) or the like as the wheels are turned. Between the flange 13 and the lower end of the vertical pipe there is also a packing 14 that prevents the lubricant of the bearing from coming into contact with the braking area of the band brake.

Both wheels of the pair of wheels 4 are mounted on a pipe shaft 17 connecting the wheels by means of cylindrical roller bearings 23 and 24 arranged on a bearing area specifically provided on the pipe shaft. The innermost bearing 23 extends inward in the axial direction to a shoulder 31 that is adjacent to the bearing area of the pipe shaft. On the side of the free wheel **4*b*, the innermost bearing 23 is axially locked by an abutment ring 26 for the rim of the wheel, and on the side of the drive wheel 4*a*, by an abutment ring 18 for the rim of the drive wheel. The outermost bearing 24, in turn, is axially locked on the side of the drive wheel 4*a* by the abutment ring 18 for the rim of the drive wheel and by a ring-shaped flange 22 fastened to the pipe shaft, and on the side of the free wheel 4*b*, by the abutment ring 26 for the rim and by a ring-shaped flange 30** fastened to the pipe shaft.

The abutment ring 18 for the rim of the drive wheel **4*a* in a pair of wheels 4 is part of the rim beyond which part of the abutment ring 18 extends, forming a cup-shaped part lying on its cylindrical surface with its bottom in an essentially vertical position. In the middle of the cup bottom there is a toothed 20 hole that fits into the toothed end of the secondary shaft 19. Power is transmitted from a traversing motor 28 through gearing 16 to the drive wheel via the toothing of the abutment ring 18. The toothing is protected by a cover 21**, which is fastened to the bottom of the cup of the abutment ring by means of screws.

The pipe shaft 17 forms a frame for the entire system of pairs of wheels. The pipe shaft protects the traversing gear against damage, functions as a bearing area, a gear casing, a cooling tunnel for the motor and a supporting surface 35 for the king pin 8 functioning as the turning bearing. Seen from the lateral side, the pipe shaft is symmetrical and has on the upper surface in the middle of the pipe shaft a short upward-opening pipe branch 34 whose upper surface 35 is provided at symmetrical intervals with threaded holes for the fastening bolts 27, with which the king pin 8 is fastened to the pipe shaft 17. In addition, the ends of the pipe shaft are provided with threaded holes for fastening the flanges 22 and 30 by means of screws.

The hollow interior of the pipe shaft is sufficiently large to accommodate the gearing 16 and the motor 28 and brakes 29 of the traversing gear. One end of the gearing is fastened to the pipe shaft by a ring-shaped flange 22 with screws 37. The ring-shaped flange 22 may be a separate flange, whereby it must also be fixed separately to the gear casing, or it may be an integral part of the gear casing, as shown in FIG. 2. Between the flange 22 and the secondary shaft 19 there is a packing 36. The countertorque of the torque affecting the wheels is supplied to the pipe shaft 17 with the flange 22 and fixing screws 37, i.e. the gear is prohibited from rotating in relation to the pipe shaft. Further, the gearing is supported on the inside of the pipe shaft by an abutment ring 25. The electric motor inside the pipe shaft operating as a traversing motor is fastened to the other end of the gearing. The pipe shaft also comprises at least two vent holes 7— one on each side—for throughflow of the cooling air. The cooling air is input through the center hole of the ring-shaped flange 30 from that end of the pipe shaft which is on the side of the free wheel **4*b*** e.g. by means of a fan (not shown in the figure) that is positioned behind the brake, and output through the vent holes past the brake and motor.

The traversing gear arrangement of the invention makes it possible to turn the direction of travel of the crane in the following manner: Usually, when a crane is steered to the lateral direction, the pairs of wheels 4 on the sub-chassis 3 are one after the other in the longitudinal direction of the sub-chassis. The band brake 15 functioning as a locking device is locked and although only wheels **4*a* are drive wheels, the crane moves in a straight line thanks to the locking effect of the band brake. If one wants to change the direction of travel, the band brake 15 is released, whereby the pair of wheels is able to turn about the symmetrically positioned vertical axis of the pair, the vertical axis coinciding with the vertical axis of the vertical pipe 5 at the end of the sub-chassis and with the vertical axis of revolution of the king pin 8. A turning action takes place since only one of the wheels in the pair of wheels is a drive wheel, while the other is a free wheel. At one end, the pairs of wheels on both sub-chassis assemblies are arranged to turn simultaneously to opposite directions as the crane is turned, whereby the forces caused by the turning action are reversed and the crane remains stationary. After the turning, the band brake 15 is locked and the crane is ready to be steered to the new direction. The turning action is performed by the traversing gear of the crane, which comprises e.g. the above-mentioned electric motor 28 and gearing 16**.

The driving and turning action of the crane are implemented by PLC control. The secondary shaft 19 comprises a pulse detector arrangement, which calculates the turning angle of the secondary shaft, starting from a specified zeroing point. The pulse calculation information is supplied to a control circuit, which forwards it to the electric motor 28. The calculation conducted by the pulse detector arrangement shows the turning angle of the wheels, and the wheels can also be adjusted to a desired angle by this arrangement. In the positions for lateral travel and longitudinal travel the pulse detector arrangement comprises extra control limits that are 90 degrees apart. At the control limits, the pulse detector information is zeroed, so that the system will always know the position of the wheels.

It will be obvious to one skilled in the art that the different embodiments of the invention are not limited to the example described above but may vary within the scope of the attached claims. For example, some part of the traversing gear may thus be located either fully or partly outside the pipe shaft.

I claim:

1. A wheel traversing gear assembly for a crane moveable on wheels comprising a hollow pipe shaft, a pair of wheels, each of the wheels being mounted on the pipe shaft, one of the pair of wheels being a drive wheel and the other a free wheel, a traversing gear including an electric motor and gearing, the traversing gear being connected to the drive wheel and at least partly disposed inside the pipe shaft, and first and second bearings arranged to roll on a surface of the pipe shaft, the drive wheel being mounted on the pipe shaft via said first roller bearing and the free wheel being mounted on the pipe shaft via said second roller bearing.

2. The assembly according to claim 1, wherein the drive wheel and the free wheel are mounted at opposite ends of the pipe shaft.

3. The assembly according to claim 2, wherein the pipe shaft is arranged to function as an air guide for the electric motor.

4. The assembly according to claim 1, wherein the pipe shaft is arranged to function as an air guide for the electric motor.

* * * * *

UNITED STATES PATENT AND TRADEMARK OFFICE

CERTIFICATE OF CORRECTION

PATENT NO. : 5,735,416
DATED : April 7, 1998
INVENTOR(S) : Jussila

It is certified that error appears in the above-indentified patent and that said Letters Patent is hereby corrected as shown below:

Title page, item [86] PCT NO: change "PCT/F195/00935" to --PCT/F195/00395

Signed and Sealed this

Sixteenth Day of November, 1999

*Attest:*

Q. TODD DICKINSON

*Attesting Officer*

*Acting Commissioner of Patents and Trademarks*